US006085533A

United States Patent [19]

Kaido et al.

[11] Patent Number: 6,085,533

[45] Date of Patent: Jul. 11, 2000

[54] METHOD AND APPARATUS FOR TORQUE CONTROL TO REGULATE POWER REQUIREMENT AT START UP

[75] Inventors: Peter F. Kaido, Verona; Kyle D. Wessells, Syracuse, both of N.Y.

[73] Assignee: Carrier Corporation, Syracuse, N.Y.

[21] Appl. No.: 09/270,186

[22] Filed: Mar. 15, 1999

[51] Int. Cl.[7] ..... F25B 49/02

[52] U.S. Cl. ..... 62/196.2; 62/204; 62/217; 62/228.5; 62/175

[58] Field of Search ..... 62/175, 196.1, 62/196.2, 196.3, 228.1, 228.5, 217, 203, 204, 205, 206; 236/1 EA

[56] References Cited

U.S. PATENT DOCUMENTS 4,446,704 5/1984 Yamazaki et al. ..... 62/196.2 X 4,938,666 7/1990 De Santis et al. .

5,062,274 11/1991 Shaw ..... 62/228.5 X 5,577,390 11/1996 Kaido et al. ..... 62/196.2 X 5,626,027 5/1997 Dormer et al. ..... 62/175

*Primary Examiner*—Harry B. Tanner

[57] ABSTRACT

At start up, at least one bank of cylinders of a compressor is allowed to compress gas and deliver the compressed gas to the system while at least the majority of the other banks are subject to hot gas bypass. The entire compressor is subject to suction modulation such that the amount of gas that can be compressed and delivered by all of the operating banks can be controlled and thereby the compressor power demand is controlled.

3 Claims, 1 Drawing Sheet

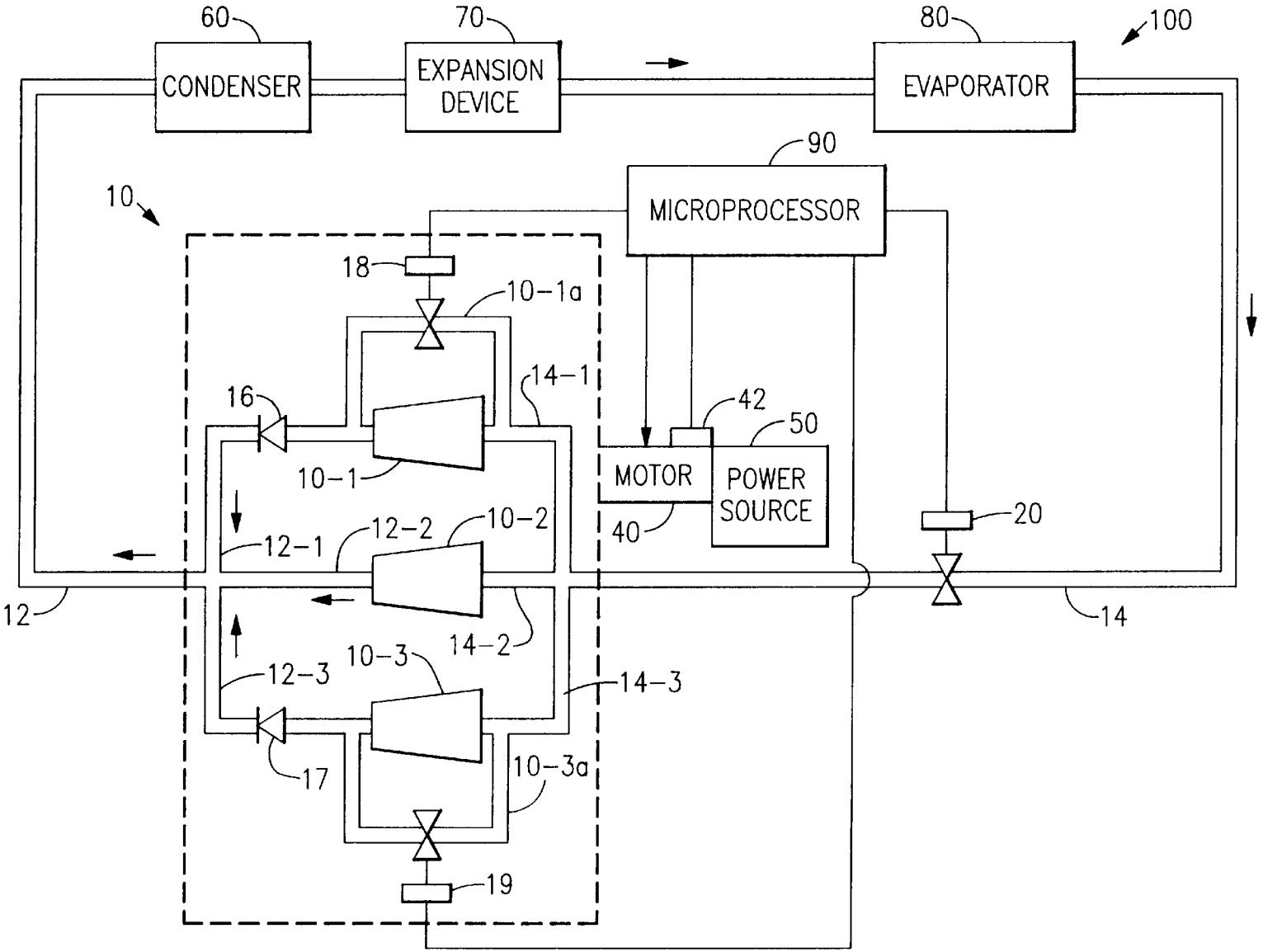
100
EVAPORATOR
80
EXPANSION DEVICE
70
CONDENSER
60
MICROPROCESSOR
90
POWER SOURCE
50
MOTOR
40
42
20
14
14-1
14-2
14-3
10-1a
10-2
10-3a
10-1
10-2
10-3
12-1
12-2
12-3
12
10
16
17
18
19

METHOD AND APPARATUS FOR TORQUE CONTROL TO REGULATE POWER REQUIREMENT AT START UP

BACKGROUND OF THE INVENTION

Compressor start up is a transient condition consisting of two dynamic phases. The first phase, or crank acceleration, is the transition from rest to running speed. For a successful start of the compressor, i.e. ramp-up from rest to running speed, the torque available from the motor must meet, or exceed, the torque demand. The torque demand consists of the torque due to cylinder pressure and the torque required for acceleration. During the initial crankshaft spin-up, the motor must overcome the peak torque occurring over the entire crankshaft revolution and have enough torque capability remaining to accelerate the crank. Starting with the pressure across the compressor equalized, the torque due to cylinder pressure starts at zero foot-pounds. As the compressor spins up, the torque load increases. However, as the crank speed approaches running speed, the inertia of the compressor running gear and rotor effectively reduce the peak torque variations. When suction cut-off unloading is employed, the crank experiences large peak torque values due to extreme pressure changes in the cylinder. Because the crank is not at full speed, the inertia of the system is not great enough to offset the torque requirements. With a limited power source, this extreme torque requirement can be too great to overcome in high pressure conditions such as those due to high ambient temperature. The second phase encompasses the transition from the point when running speed is achieved to a point when normal system operating pressures are attained. After the compressor reaches running speed, it must pump down the low side of the system, i.e. from the compressor suction to the expansion device.

SUMMARY OF THE INVENTION

In a refrigeration system such as a transport refrigeration system powered by a generator, high pressure/high ambient temperature starts of the refrigeration compressor impose a high load on the generator. Due to size constraints the output of the generator is limited and is lower than the maximum demand of the compressor under severe conditions. Compressor demand can be controlled with compressor capacity devices which, typically, block the flow of suction gas to the cylinders of the compressor (suction cut-off) or recirculate discharge gas back to suction within the cylinder head (hot gas bypass). Bypassing the discharge gas of the entire compressor to suction reduces the excessive torque variations during the initial phase of start up but does not permit the second stage of start up where the low side of the system is pumped down. Specifically, hot gas bypass of the entire compressor does not deliver compressed gas to the system and, accordingly, does not pump down the system. The present invention utilizes hot gas bypass unloading in conjunction with suction line throttling to minimize compressor torque requirements from initial crank acceleration through pump down.

It is an object of this invention to limit compressor torque at start up.

It is another object of this invention to limit the power required to start a compressor and bring it to a steady-state condition.

It is an additional object of this invention to limit the power required at start up under high ambient temperature conditions.

It is a further object of this invention to control the power requirements of a compressor in a manner that reduces power demand. These objects, and others as will become apparent hereinafter, are accomplished by the present invention.

Basically, at start up, at least one bank of cylinders of a compressor is allowed to compress gas and deliver the compressed gas to the system while at least the majority of the other banks are subject to hot gas bypass. The entire compressor is subject to suction modulation such that the amount of gas that can be compressed and delivered by all of the operating banks can be controlled and thereby the compressor power demand is controlled.

BRIEF DESCRIPTION OF THE DRAWING

For a fuller understanding of the present invention, reference should now be made to the following detailed description thereof taken in conjunction with the accompanying drawing wherein:

The FIGURE is a schematic representation of a refrigeration system employing the present invention.

DESCRIPTION OF THE PREFERRED EMBODIMENT

In the FIGURE, the numeral 100 generally designates a refrigeration system, such as a transport refrigeration system. Refrigeration system 100 includes a closed refrigeration circuit serially including compressor 10, discharge line 12, condenser 60, expansion device 70, evaporator 80 and suction line 14. Compressor 10 is made up of a plurality of banks, with three banks, 10-1, 10-2 and 10-3, being illustrated. Compressor 10 is driven by motor 40 and motor 40 is, in turn, powered from a power source 50 such as a generator. Refrigeration system 100 is under the control of microprocessor 90 which receives a number of inputs such as the sensed ambient temperature, condenser entering air temperature, zone temperature, and zone set point. Responsive to sensed inputs, microprocessor 90 controls compressor 10 and motor 40 and can control power source 50. The system and operation described so far is generally conventional.

Suction line 14 branches into paths 14-1, 14-2 and 14-3 which are connected to banks 10-1, 10-2 and 10-3, respectively. Discharge path 12-1 containing check valve 16, discharge path 12-2, and discharge path 12-3 containing check valve 17 respectively connect banks 10-1, 10-2 and 10-3 to discharge 12. Bank 10-1 has a bypass 10-1*a* connecting path 12-1 with path 14-1 and containing on-off solenoid valve 18 which is under the control of microprocessor 90. Similarly, bank 10-3 has a bypass 10-3*a* connecting path 12-3 with path 14-3 and containing on-off solenoid valve 19 which is under the control of microprocessor 90. Suction modulation valve 20 controls the flow in line 14 and is under the control of microprocessor 90. Valve 20 is infinitely variable between closed and fully open and may be a solenoid valve, as illustrated, which is pulsed with the rate of pulsing and the duration of opening/closing being variable.

When a refrigeration system is shut down, it is common practice to equalize the pressure across the system as part of the shut down procedure. When the system is catastrophically stopped as by failure of the power source, a time delay prevents an immediate restart such that pressure equalization can take place. The reason that pressure equalization is desired is that the discharge valves of the compressor must open against the system pressure action on the valves plus any bias of the valve structure. As discussed above, compressor capacity can be controlled at start up as well as during normal operation but the use of suction modulation and hot gas bypass are not used serially on compressors.

Assuming that refrigeration system 100 is off and the pressure is equalized across compressor 10, the starting of compressor 10 responsive to zone inputs to microprocessor 90 or due to bringing refrigeration system 100 into operation will start with the opening of valves 18 and 19 and the restricted opening of valve 20. It should be noted that valves 18 and 19 would not be opened until the system pressure, as experienced by compressor 10, is low enough to limit compressor power to acceptable limits. This is because there can be enough refrigerant between compressor 10 and expansion device 70 to overload compressor 10 if it is operating with three banks, six cylinders, at high system pressures. With valves 18 and 19 open, the pressure differential across banks 10-1 and 10-3 is, nominally, zero with no work/compression taking place but with a heating of the refrigerant due to friction and flow losses. Bank 10-2, to the extent permitted by the opening of valve 20 and the capacity of bank 10-2, draws in refrigerant gas from suction line, through path 14-2, compresses the gas, and delivers the compressed gas via path 12-2 into discharge line 12 and thence to condenser 60, etc. As bank 10-2 draws in gas from suction line 14 and delivers it to discharge line 12, the pressure differential across compressor 10 starts to increase due to the decrease in suction pressure as well as to the build up in discharge pressure. When the motor 40 gets up to speed, i.e. the initial crankshaft spin up, and if the suction pressure is low enough to limit compressor power, valves 18 and 19 are closed but valve 20 is unchanged. Otherwise, the compressor 10 continues to run with valves 18 and 19 open until the suction pressure is reduced sufficiently. Accordingly, when valves 18 and 19 are closed, banks 10-1, 10-2 and 10-3 are collectively compressing the same mass of gas as bank 10-2 was doing alone, assuming that valve 20 had sufficiently limited flow. The torque requirements do not significantly change due to the closing of valves 18 and 19 since bank 10-2 is doing less work. With banks 10-1, 10-2 and 10-3 operating, valve 20 gradually increases the amount of refrigerant supplied to the compressor 10 and subsequently compressed and supplied to the system. As more refrigerant is compressed and delivered to the system, normal operating pressures are attained. Valve 20 can be controlled responsive to a number of conditions. As illustrated, the current in motor 40 is sensed by current sensor 42 which is connected to microprocessor 90. Microprocessor 90 controls valve 20 so as to limit the refrigerant supplied to compressor 10 during start up so as to limit the current draw of motor 40 which is powered by power source 50 and drives compressor 10. Valve 20 may also be controlled based upon sensed pressure where there is correlation between pressure and current or it may be time sequenced so as to prevent an excessive power demand.

From the foregoing it should be clear that the power draw required for a fully loaded start up is avoided by starting the compressor with only one bank compressing gas and that in a limited fashion due to the gas supply being subject to suction modulation. The other banks are hot gas bypassed such that the discharge valves are opening at a pressure nominally equal to suction pressure and the bias of the valve members. It is only when the compressor 10 is up to speed that all the banks are compressing gas under the limits of suction modulation. With all banks compressing, the suction modulation is eliminated.

Although a preferred embodiment of the present invention has been illustrated and described, other modifications will occur to those skilled in the art. It is therefore intended that the present invention is to be limited only by the scope of the appended claims.

What is claimed is:

1. A method for torque control to regulate power requirements at start up in a refrigeration system with a compressor having plural banks including the steps of:

prior to powering said compressor, limiting the amount of refrigerant supplied to said compressor and bypassing a majority of the banks of said compressor such that at least one bank is always connected to suction and discharge;

after said compressor is powered and brought up to running speed, blocking the bypassing of all of said majority of banks;

with all of said banks connected to suction and discharge, increasing the amount of refrigerant supplied to said compressor.

2. The method of claim 1 wherein the step of blocking the bypassing of all of said majority of banks only occurs after suction pressure has been reduced sufficiently to reduce compressor power requirements.

3. In a refrigeration system, means for torque control to regulate power requirements at start up comprising:

a compressor having a plurality of banks;

means for driving said compressor;

a suction line for supplying refrigerant to said compressor;

a discharge line for delivering compressed refrigerant from said compressor to said system;

means for controlling the amount of refrigerant supplied to said compressor such that a limited amount of refrigerant is supplied to said compressor means for selectively bypassing a majority of said banks of said compressor such that at least one bank is always connected to said suction line and said discharge line.

* * * * *